US005695434A

United States Patent [19]

Dalebout et al.

[11] Patent Number: 5,695,434

[45] Date of Patent: Dec. 9, 1997

[54] RIDING-TYPE EXERCISE MACHINE

[75] Inventors: William T. Dalebout; Scott R. Watterson, both of Logan, Utah

[73] Assignee: Icon Health & Fitness, Inc., Logan, Utah

[21] Appl. No.: 382,342

[22] Filed: Feb. 1, 1995

[51] Int. Cl.[6] ..... A63B 21/00

[52] U.S. Cl. ..... 482/96; 482/95; 482/72

[58] Field of Search ..... D21/191, 194, D21/195

[56] References Cited

U.S. PATENT DOCUMENTS

| | | | |
|---|---|---|---|
| D. 277,304 | 1/1985 | Smith et al. . | |
| D. 344,112 | 2/1994 | Smith . | |
| D. 356,128 | 3/1995 | Smith et al. . | |
| D. 358,437 | 5/1995 | Wang et al. | D21/191 |
| 2,470,544 | 5/1949 | Bell . | |
| 2,642,288 | 6/1953 | Bell . | |
| 2,714,507 | 8/1955 | Goodrich . | |
| 2,924,456 | 2/1960 | Miller . | |
| 3,446,503 | 5/1969 | Lawton . | |
| 3,976,058 | 8/1976 | Tidwell . | |
| 4,043,552 | 8/1977 | Kerkonian . | |
| 4,170,351 | 10/1979 | Ozbey et al. . | |
| 4,176,836 | 12/1979 | Coyle . | |
| 4,188,030 | 2/1980 | Hooper . | |
| 4,300,760 | 11/1981 | Bobroff . | |
| 4,452,448 | 6/1984 | Ausherman . | |
| 4,641,833 | 2/1987 | Trethewey . | |
| 4,684,126 | 8/1987 | Dalebout et al. . | |
| 4,809,976 | 3/1989 | Berger . | |
| 5,156,650 | 10/1992 | Bals . | |
| 5,178,599 | 1/1993 | Scott | 482/113 |
| 5,254,067 | 10/1993 | Habing et al. . | |
| 5,299,997 | 4/1994 | Chen . | |
| 5,306,218 | 4/1994 | Chen . | |
| 5,330,404 | 7/1994 | Lopeteguy et al. . | |
| 5,338,277 | 8/1994 | Yang . | |
| 5,342,269 | 8/1994 | Huang et al. | 482/95 |
| 5,356,357 | 10/1994 | Wang et al. . | |
| 5,366,428 | 11/1994 | Liao . | |
| 5,370,594 | 12/1994 | Grinblat . | |
| 5,421,795 | 6/1995 | Chen . | |
| 5,453,066 | 9/1995 | Richter, Jr. | 482/96 |
| 5,464,378 | 11/1995 | Yu . | |

FOREIGN PATENT DOCUMENTS

| | | |
|---|---|---|
| 95226 | 3/1983 | European Pat. Off. . |
| 1468272 | 2/1966 | France . |
| 2151551 | 3/1973 | France . |
| 2215119 | 11/1973 | Germany . |
| 5110842 | 3/1976 | Japan . |
| 1248615 | 7/1986 | U.S.S.R. . |
| 8000099 | 6/1981 | WIPO . |

OTHER PUBLICATIONS

Silver Colored Rider, six photos plus sketch or diagram.
Electric Rider Cycle, Exercycle, undated.
Healthrider parts description, copyright Apr. 26, 1994.
Aerrobicrider parts description, undated.
Voit Body Jack Advertisement, Nov. 1–4, 1994.
Voit Gravity Rider, with enlarged photocopy, Jul.–Aug., 1984.
Exerhealth Advertisement for AerobicRider.

*Primary Examiner*—Jerome Donnelly
*Attorney, Agent, or Firm*—Trask, Britt & Rossa

[57] ABSTRACT

A riding-type exercise machine has a frame with a leg structure for supporting the machine on a support surface. A user support rotatably is connected to the frame and interconnected to rotatable lever structure by a bar for synchronized movement. A hydraulic cylinder is interconnected between the user support and the frame to resist movement of the user support and in turn the interconnected lever structure. The hydraulic cylinder is adjustable to vary the resistance to movement of the user support and the lever structure.

24 Claims, 7 Drawing Sheets

RIDING-TYPE EXERCISE MACHINE

BACKGROUND OF THE INVENTION

1. Field of the Invention

This application relates to exercise machines and more particularly the type of exercise machine which the user mounts and rides in the performance of exercises.

2. State of the Art

Exercise machines in which the user mounts the machine and in effect rides the machine in the performance of exercises are known. For example U.S. Pat. No. 4,300,760 (Bobroff) illustrates one form of exercise machine in which the user mounts the machine and operates a lever mechanism with the arms and feet against a resistance which is the user's weight positioned upon a seat.

Commercial devices are known including the HEALTHRIDER™ manufactured and sold by ExerHealth, Inc. of Salt Lake City, Utah. The HEALTHRIDER machine has a frame with a rotatable or movable lever interconnected to a seat. The lever is operated by the user's hand and feet against the resistance of the user reclining on a seat in a fashion similar to that illustrated in the Bobroff patent.

Other known exercise machines of the riding type are powered by a motor to move the seat and movable handle structure.

SUMMARY OF THE INVENTION

A riding exercise machine has a frame with leg means for supporting the frame upon a support surface. A user support structure is rotatably connected to the frame at its proximal end. A user support is positioned proximate the distal end of the user support structure. The user support structure is movable between a first position toward the frame and a second position displaced from the first position and away from the frame.

The riding exercise machine also has limb means for operation by the limbs of the user. The limb means is rotatably connected to the frame. The limb means has a foot structure for supporting the user's feet when the user is positioned upon the user support. The limb means also has hand structure for grasping by the user's hands when the user is positioned on the user support. The limb means is movable between a first position in which the foot structure is positioned toward the frame and the hand structure is positioned away from the frame, and a second position in which the foot structure is positioned outwardly away from the frame and the hand structure is positioned inwardly toward the frame.

Connection means are also provided for interconnecting the limb means and the user support structure to urge the user support structure to its first position when the limb means is positioned in its first position, and to urge the user support structure to its second position upon movement of the limb means to its second position.

The riding exercise machine includes resistance means interconnected between the frame and selectively either the user support structure or the limb means to resist movement of the limb means and the user support structure.

In a preferred arrangement, the limb means includes a support secured to the frame and formed to extend away therefrom. A lever member is rotatably secured to the support. The lever member preferably has the hand structure positioned at its upper end and the foot structure positioned proximate its lower end.

In an alternate configuration, the connection means includes a bar having one end rotatably connected to the lever member and the other end rotatably connected to the user support structure. The resistance means is also preferably connected proximate the bar structure to said user support structure.

In yet another configuration, the resistance means is a resistance cylinder connected at one end to the bar structure and to the other end to said frame. The resistance cylinder is desirably a hydraulic cylinder. Further, the hydraulic cylinder preferably includes means to adjust the resistance to movement of the piston of the hydraulic cylinder relative to the frame and the user support structure.

In a desired configuration, the leg means includes a first leg structure extending outwardly from the frame. The first leg structure is formed for positioning on a support surface. The leg means also includes second leg structure extending outwardly from the frame and spaced from the first leg structure. The second leg structure is formed for positioning on a support surface.

In a preferred arrangement, the frame includes a pair of spaced apart members. The resistance cylinder is positioned between the spaced apart members.

In a desired arrangement, the support of the limb means extends upwardly and outwardly from the first leg structure. The lever in turn is rotatably connected thereto proximate the distal end of the support. Also desirably, the lever members includes a left member and a right member spaced from the left member. A handle bar connected to the left member and the right member at the upper end thereof as the hand structure.

It is also desired that the bar member of the connection means includes a left member connected to the left member of the lever and a right member connected to the right member of the lever. The left and right members of the bar member are rotatably connected to the user support structure by a pin. The resistance cylinder preferably has a bushing at one end thereof connected to the user support structure by the pin.

In an alternate configuration a monitoring means is positioned proximate the distal end of the support of the limb means for use by the operator to monitor the exercise being performed.

BRIEF DESCRIPTION OF THE DRAWINGS

In the drawings which illustrate what is presently regarded as the best mode for carrying out the invention.

DETAILED DESCRIPTION OF THE ILLUSTRATED EMBODIMENT

Figure 1:
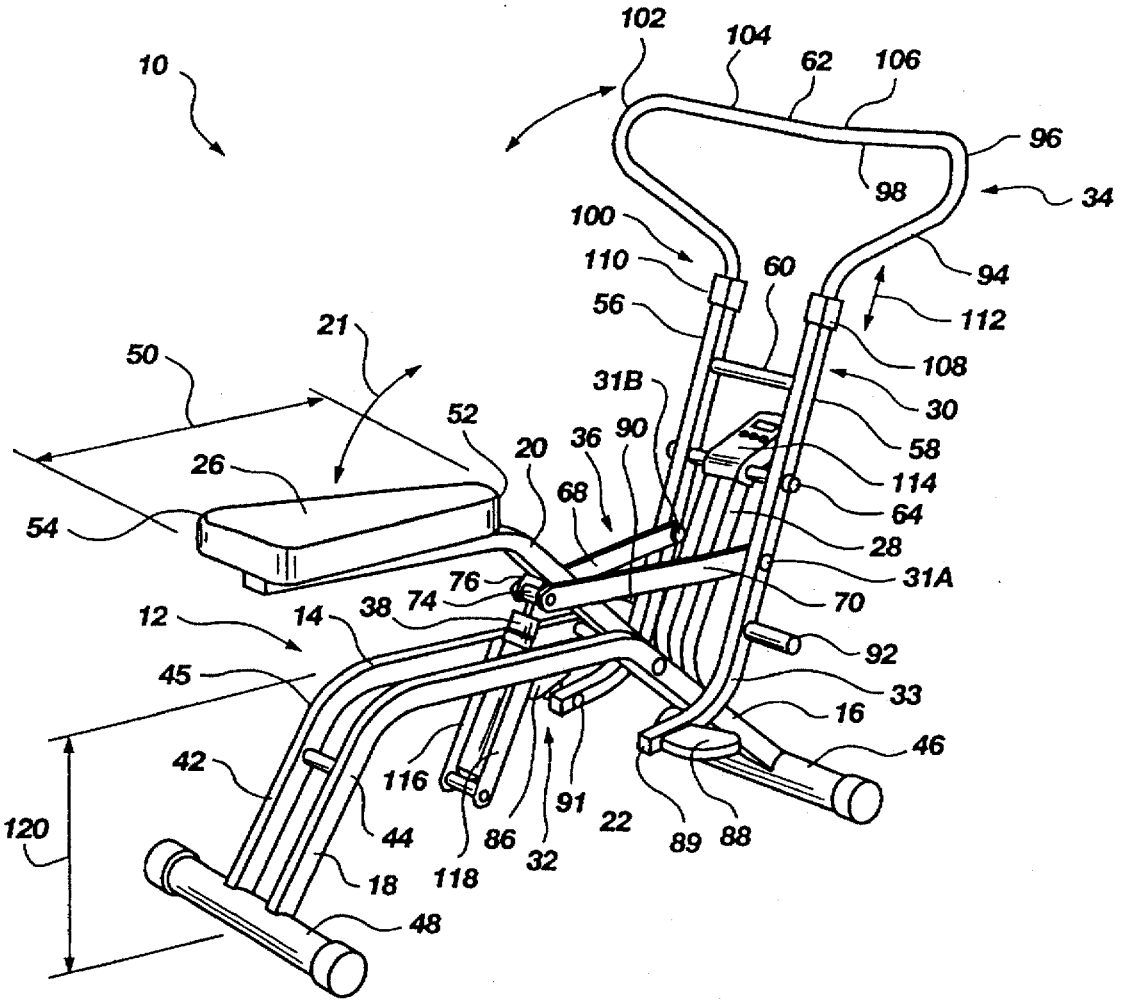
FIG. 1 is a perspective side view of the riding exercise machine of the invention.
Figure 2:
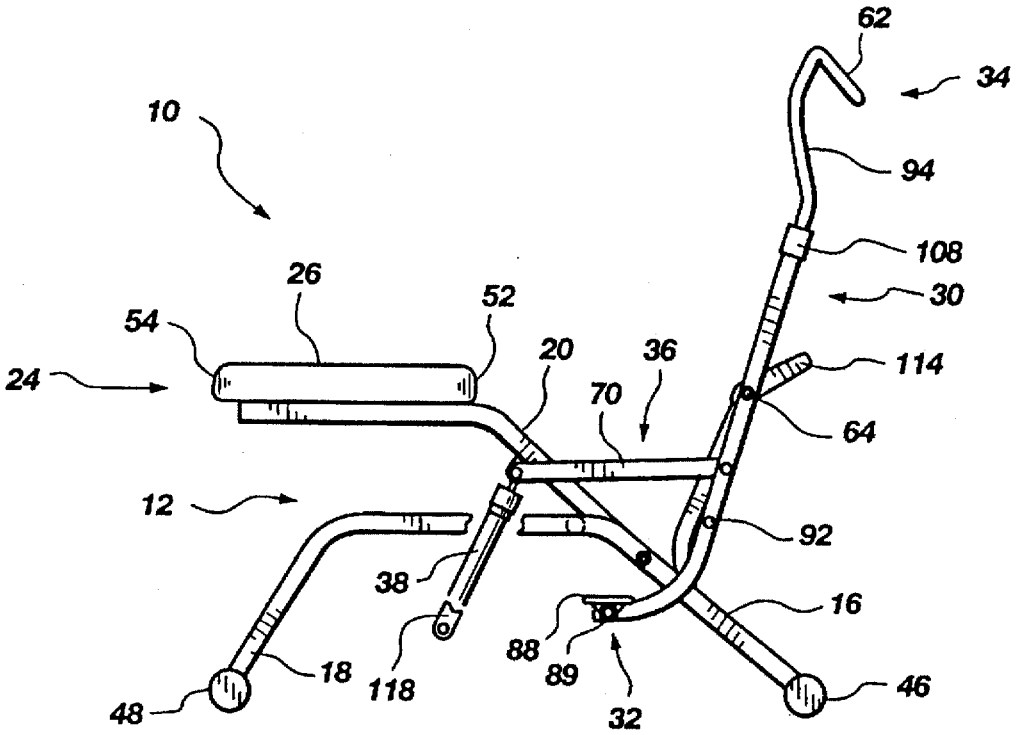
FIG. 2 is a side view of the riding exercise machine of FIG. 1 in its first position.
Figure 3:
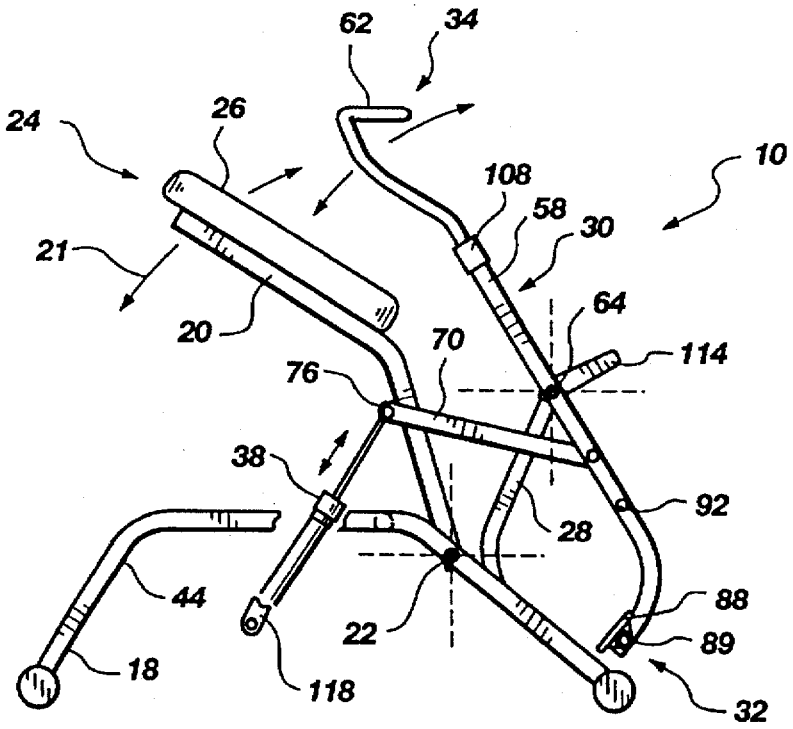
FIG. 3 is a side view of the riding exercise machine of FIG. 1 in its second position.

The riding exercise machine 10 of FIGS. 1–3 has a frame 12 that includes a central portion 14 and leg means which here are illustrated to be a first or forward leg structure 16 and a second or rear leg structure 18.

The riding exercise machine 10 of FIGS. 1–3 also includes a user support structure 20 which is rotatably connected to the frame 12 at the axle 22. The user support structure 20 is movable or rotatable 21 between a first position shown in solid in FIG. 1 and 2 and a second position 24 shown in FIG. 3. The user support structure 20 includes a user support 26 secured proximate the distal end of the user support structure 20.

A limb means here includes a support 28 connected to the frame 12 and a lever structure 30 rotatably connected to the support 28. The lever structure 30 has foot support structure 32 positioned at a lower end 33 to receive the feet of a user positioned on the user support 26. The lever structure 30 also has hand structure 34 positioned for grasping by the hands of a user positioned on the user support 26. The lever structure 30 is interconnected to the user support structure 20 by connection means which is here shown to be a bar structure 36 rotatably connected to the lever structure 30 at pins 31A and 31B and to the user support structure 20. Resistance means is interconnected alternately and selectively between the lever structure 30 and the frame 12 or the user support structure 20 and the frame 12. As here shown, the resistance means is a resistance cylinder 38 interconnected between the user support 20 and the frame 12 as more fully discussed hereinafter.

The frame 12 as illustrated in FIGS. 1–3 has a first leg structure 16 and a second leg structure 18 with the central section 14 positioned thereinbetween. As better seen in FIG. 1, the frame 12 includes two spaced apart or side-by-side elements 42 and 44. The spaced-apart elements 42 and 44 are tubular and unitarily formed with the first leg structure 16 and the second leg structure 18. The leg structure 16 has a cross foot 46 connected at the distal end thereof to provide stable support on a support surface. Similarly, the second leg structure 18 has a cross foot 48 connected to the distal end thereof to provide support on a support surface. As here shown, the frame 12 with the first leg structure 16 and second leg structure 18 have at least one spacer 45 to maintain the side-by-side elements 42 and 46 in general symmetrical alignment. The frame 12 with the first leg structure and second leg structure 18 together are formed in an open u-shaped configuration as shown. Alternate configurations may be devised to provide elevated support to the central section 14 and to the user. Such alternate configurations may vary geometrically and structurally but necessarily provide support to a user performing exercises and support to the entire machine 10 on a support surface. The configuration illustrated in FIG. 1 including the spaced-apart elements 42 and 44 is preferred.

In reference to the cross feet 46 and 48, alternate configurations of floor contacting feet may be devised or used as desired.

The user support structure 20 is here shown to be a single tubular member rotatably connected by a pin or axle 22 for movement between a first position shown in FIGS. 1 and 2 in solid and a second position 24 shown in FIG. 3. The user support 26 is a seat shown as a cushioned elongated member of the type that can be easily straddled by a user with the user's legs extending on opposite sides thereof. The user support structure 26 is elongated with a length 50 selected to provide for users having different sized legs. That is, a user may be able to ride on the support, seat, or saddle 26 near the forward portion 52 if the user has short legs. Alternately, the user may ride near the rear portion 54 of the saddle 26 if the user has long legs. In turn, the elongated user support or saddle 26 accommodates users of different heights of leg lengths. Nevertheless, a variety of different standard saddles or bicycle saddles may be used as desired.

The limb means as hereinbefore discussed include the upright structure 28 which is connected to the frame 12 and more specifically, the first leg structure 16 by any conventional means including belts or welding as desired. The support 28 extends upwardly and away from the frame 12 as shown and is formed to provide strength and support for the lever structure 30.

The lever structure 30 here includes a left lever member 56 and a right lever member 58 interconnected by a strengthening bar 60 and as here shown by the hand structure 34 and more specifically the handle bar 62. The lever structure 30 is rotatably connected to the support 28 by an axle 64. Appropriate bushings or bearings (not shown) are positioned within the left lever member 56 and the right lever member 58 for movement of the lever structure 30 from a first position as shown to a second position shown in FIG. 3 in which the foot support structure 32 is positioned away from the first position and outwardly from the frame 12 and the first leg structure 16 with the handle structure 34 and more specifically handle bar 62 positioned in FIG. 3 toward the frame 12. The bar structure 36 interconnects the user support structure 20 and the lever structure 30 and operates to force the user support structure 20 and in turn the user support or saddle 26 to the second position 24 when the lever structure 30 is positioned in its second position 66.

It may be noted that the lever structure 30 may also be comprised of two different pieces separately pivoted and separately operable. That is a separate hand piece may be rotatably connected and a separate foot piece may be rotatably operated so that a user may operate one or the other or both.

Figure 4:
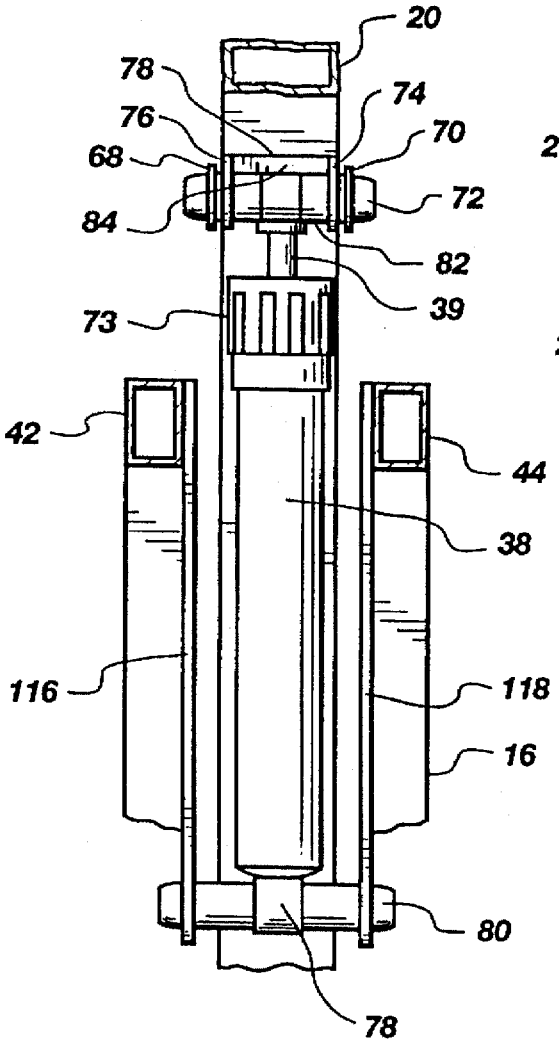
FIG. 4 is a partial rear view of a portion of the riding exercise machine of FIG. 1.

As better seen in FIG. 4, the bar structure 36 includes a left strap 68 and a right strap 70 rotatably secured to the user support 20 by a pin 72 that extends through a bracket having a right ear 74 and a left ear 76. The straps 68 and 70 are made of a metal sized to provide the needed longitudinal strength.

The resistance means and more specifically the resistance cylinder 38 is a hydraulic cylinder which is positioned between the left element 42 and the right element 44 of the frame 12. The cylinder 38 is rotatably secured at one end 78 by a pin 80. It is secured at its other end by a bushing 82 positioned in between the right ear 74 and the left ear 76 of the bracket 78 which is fixedly secured such as by welding or boiling to the underside of the user support structure 20. The bushing 82 is hollow and rotates about the pin 72. In turn, the hydraulic cylinder 38 has a piston (not shown) connected to a rod 39 which extends as the user support structure 20 moves from its first position shown in FIGS. 1 and 2 to its second position 24 shown in FIG. 3. In so moving, the hydraulic cylinder 38 resists movement in turn providing the user with resistance to movement for purposes of performing exercise.

The hydraulic cylinder 38 of FIG. 4 has a collar 84 which is rotatable to vary the fluid flow of the hydraulic from one end of the piston to the other end of the piston which is positioned within the cylinder to in turn vary the amount of resistance experienced as the user support structure 20 and in turn the user support or saddle 26 is moved from its first position to its second position 24 and back again to its first position as shown in solid. That is, resistance can be experienced to movement in both directions.

Figure 5:
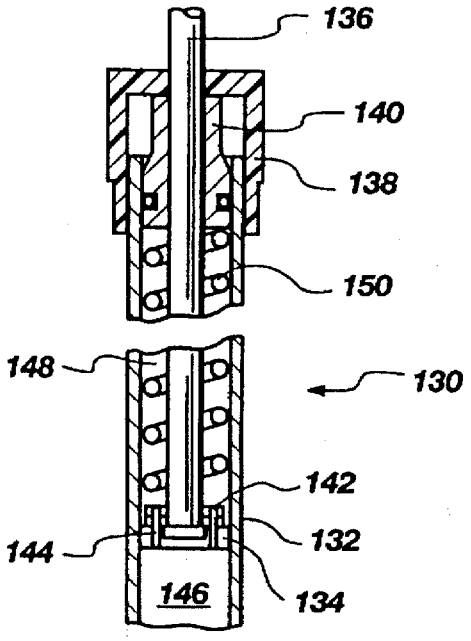
FIG. 5 is a partial cross-sectional schematic of a hydraulic cylinder for use with the machine of the invention.

FIG. 5 shows a schematic cross section of one form of suitable hydraulic cylinder. More specifically, cylinder 130 has an outer wall 132 with a piston 134 disposed therein. The piston rod 136 extends upwardly for connection to a bushing or the like. A collar 138 is secured to the piston rod 136 and to a transmission 140. Upon rotation of the collar 138, the transmission 140 and in turn the piston rod 136 rotate relative to the piston 134. In turn, washers 132 with holes 142 align and misalign with a plurality of orifices 144 formed in the piston 134 to regulate the flow of hydraulic fluid (such as oil) from one side 146 to the other side 148 of the piston 134. A spring 150 urges the piston 134 to its at-rest position after displacement. As stated, FIG. 3 is a schematic illustrating the principles of a suitable cylinder. Other forms or arrangements may be used as desired.

Figure 6:
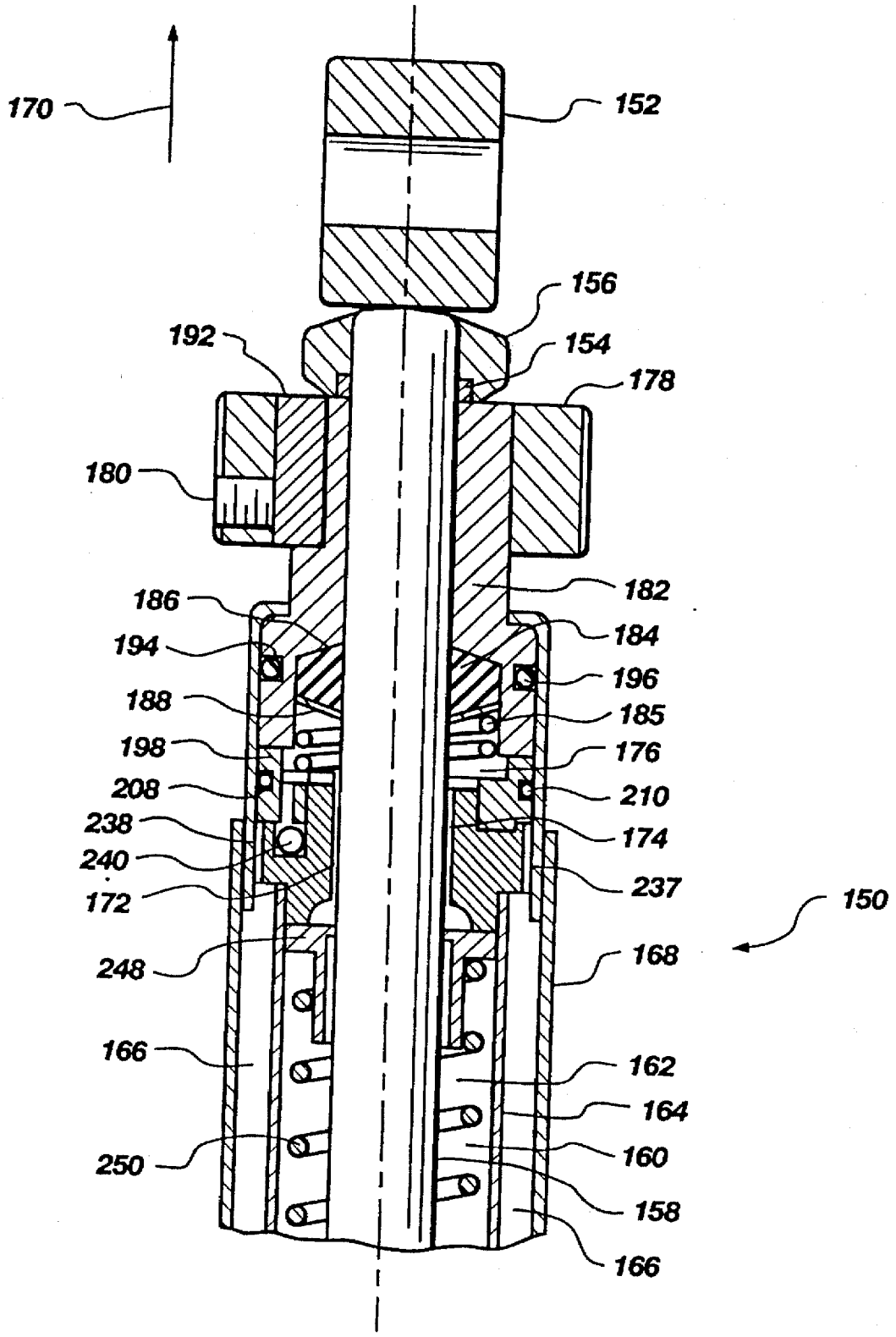
FIG. 6 is a partial cross section and cut-away of a hydraulic cylinder for use with the machine of the invention.

FIG. 6 depicts a preferred hydraulic cylinder 150 which has a bushing 152 for connection by pin 72 to the user support member 20 in a manner similar to bushing 82 (FIG. 4). The cylinder has a spacer 154 with a cushion 156 made out of an elastic-like material to cushion contact between the bushing 152 and other components of the cylinder 150.

A shaft 158 is connected to the bushing 152 at one end and to a piston (not shown) at its other end. Oil or another acceptable hydraulic fluid is in the cylinder which has an interior chamber 162 defined by interior wall 164 and an exterior chamber 166 defined by the interior wall 164 and exterior wall 168. As will be seen upon outward movement 170 of the shaft 158, the oil 158 moves upward along the shaft 158 through slots 172 and 174 into a reservoir chamber 176. The oil then passes through orifices and channels as hereinafter described into the exterior chamber 166. The collar 178 is secured to the transmission 182 by a set screw 180 (or by friction fit, key way locking or the like) so that upon rotation of the collar 178 by the user, the orifices or channels vary in cross section to regulate oil flow and interior resistance to movement of the shaft 158 outwardly 170 or inwardly.

An oil seal is positioned proximate the transmission 182 to inhibit movement of oil 160 along the shaft 158 above the reservoir chamber 176. More specifically an elastically deformable seal member 184 is snugly positioned in a notch 186 in the transmission 182. A retaining washer 188 is positioned against the seal member 184 to retain the seal member 184 in the notch 186 and to act as a wear surface for the seal spring 185. That is the seal spring urges the washer 188 against the seal member 184 to continuously force the seal member 184 against the shaft 158 and in turn effect a seal.

Figure 7:
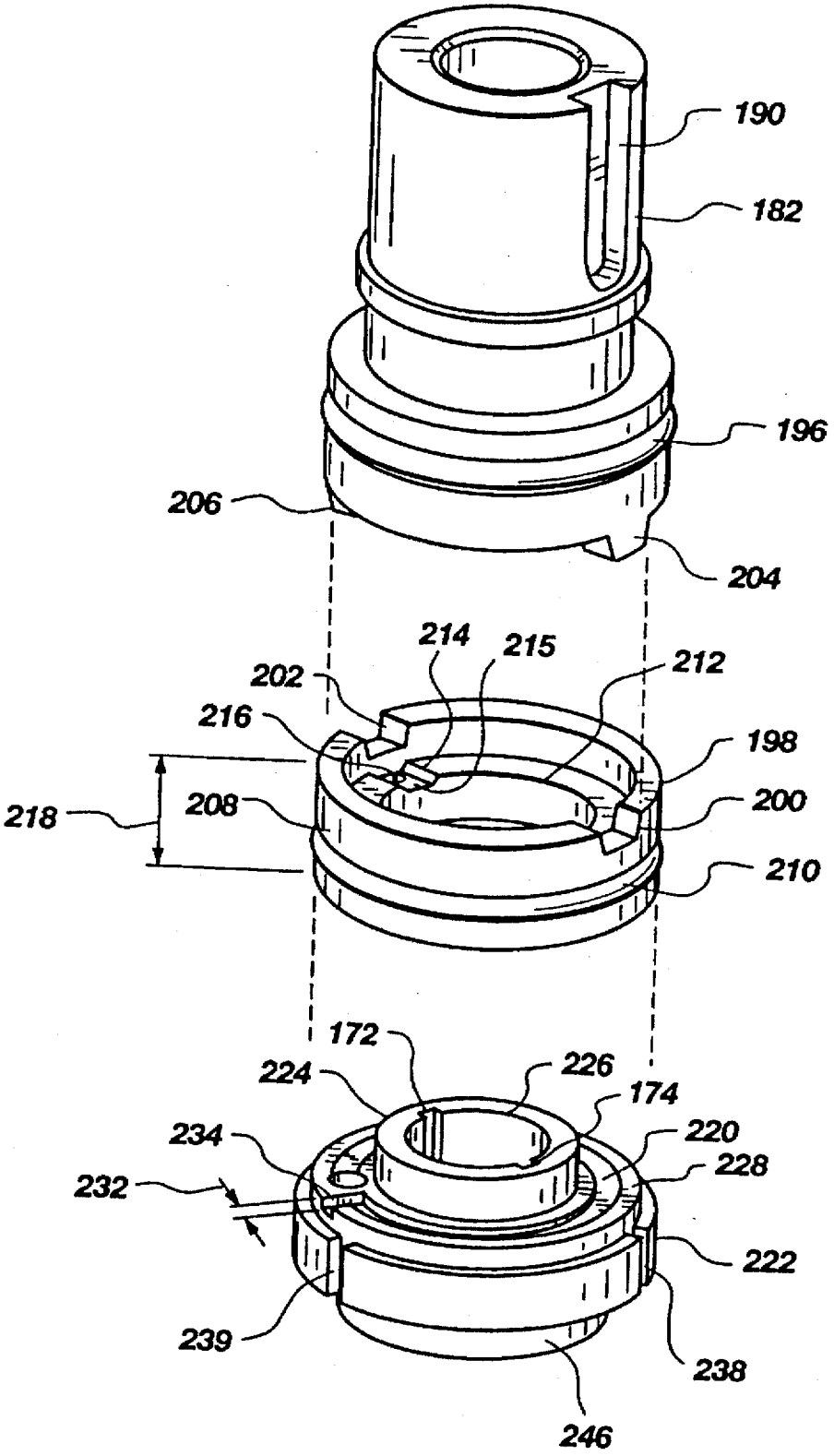
FIG. 7 is an exploded perspective of selected internal components of the hydraulic cylinder of FIG. 6.
Figure 8:
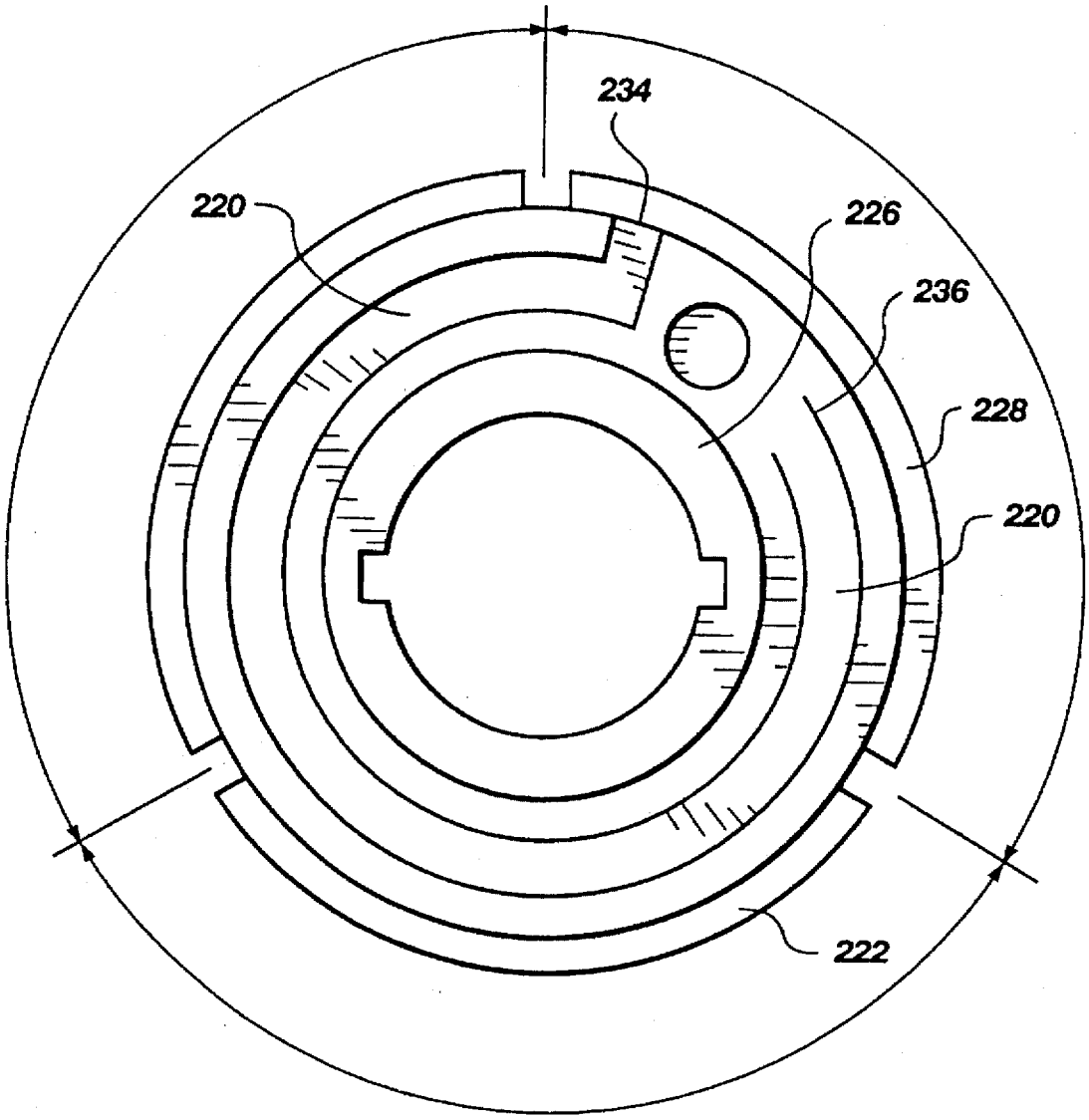
FIG. 8 is a top planar view of one component of the hydraulic cylinder of FIG. 6.
Figure 9:
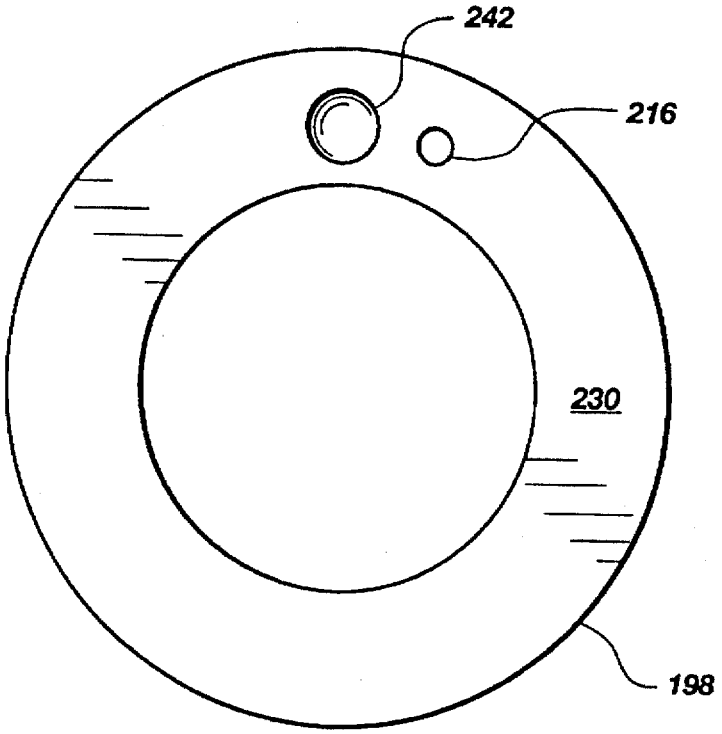
FIG. 9 is a bottom planar view of one component of the hydraulic cylinder of FIG. 6.
Figure 10:
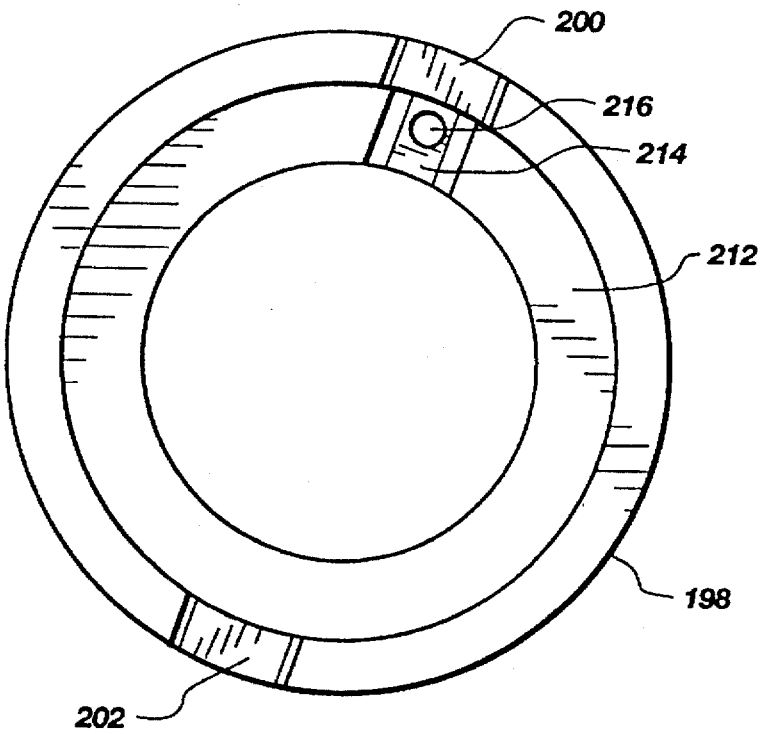
FIG. 10 is a top planar view of one component of FIG. 9.

As better seen in FIG. 7, the transmission 182 has a key way 190 to receive key 192 held in place by set screw 180 (FIG. 6). The transmission has an "o" ring slot 194 (FIG. 6) and an "o" ring 196 to seal the transmission 182 against the outer wall 168.

An axle bushing 198 has slots 200 and 202 sized to snugly receive lugs 204 and 206 of the transmission 182. The axle bushing 198 has an "o" ring slot 208 (FIG. 6) and an "o" ring 210 to seal it against the outer wall 168. The axle bushing 198 has an interior ledge 212 with a recessed groove 214 formed therein. An axle orifice 216 is formed in the groove to extend the length 218 of the axle bushing 198 to communicate with a channel 220 formed in the bearing 222 when the collar 224 is inserted into the axle bushing 198. That is, when the bearing 222 is mated with the axle bushing 198, the upper surface 226 of the collar 224 is slightly under the inter ledge 212 of the axle bushing 198 to be virtually even with the bottom 215 of the groove 214. Thus, oil can proceed up the slots 172 and 174 into a chamber 176 formed between the surface 212 and the retaining washer 188. Oil can then proceed down through orifice 216 into channel 220 formed in the surface 228 which mates snugly with the bottom surface 230 of the axle bushing 198. The channel 220 is arcuate with a depth 232 that decreases from the discharge port 234 to its beginning 236. That is the channel 220 gets deeper or has an increasing side wall dimension between the beginning 236 and the discharge port 234. Thus, oil flow transmitted into the channel 220 from orifice 216 is regulated by the angular rotation of the axle bushing 198 relative to the bearing 222. In turn, the oil is metered through discharge port 234 into the exterior chamber 166 through channels 238 and 239 formed in the bearing 222.

A ball 240 is positioned between the bottom surface 230 of the axle bushing 198 and the top surface 228 to ride partially in the channel 220. A ball detent 242 is formed in the under side of the bottom surface 230 and positioned to register with the ball 240 when the ball 240 is positioned between the discharge port 234 and the end 236. A similar ball detent 244 is formed in the surface 228 between the end 236 of the channel 220 and the discharge part 234. When the axle bushing 198 is rotated relative to the beating 222 to register the ball 240 with detents 242 and 244. The oil flow is stopped so the shaft 158 cannot move relative to the outer wall 168.

The lower end 246 of the bearing 222 is formed to contact a spring bushing 248 which in turn contacts spring 250 positioned to urge the shaft 158 toward an at rest position.

Figure 11:
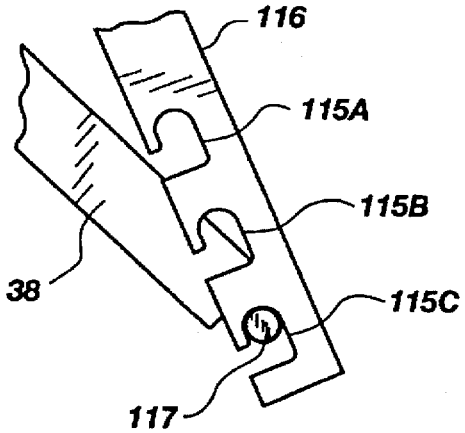
FIG. 11 is a partial side view of a hydraulic cylinder for use with the invention.

Other types of cylinders may be used which may not have variable orifices but are nonetheless mechanically adjustable. For example, a plurality of notches such as notches 115A, 115B and 115C may be formed in the members 116 and 118 to interconnect with a hook or transverse bar 117 positioned at the end of a resistance cylinder 38 as shown in FIG. 11.

Resistance can also be imposed by friction plates or discs and a related knob operable upon rotation to increase or decrease resistance.

Figure 12:
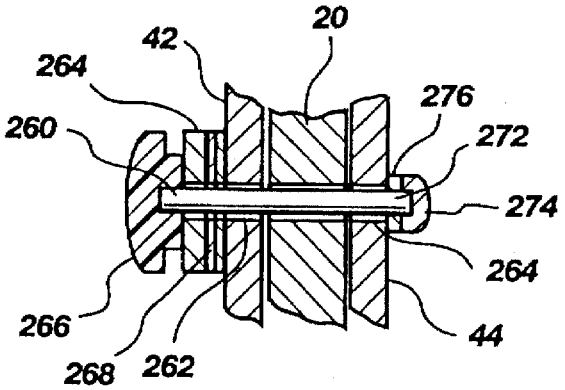
FIG. 12 is a partial cross-sectional view of a portion of the machine of the invention with alternate resistance structure.

FIG. 12 shows an alternate axle 260 extending rotatably through apertures 262 and 264 in elements 42 and 44. The user support structure 20 is fixedly secured to the shaft by welding or by a slot and key or other similar device. A knob 266 urges a friction plate 264 with friction discs 268 against a wear plate 220. The other end 272 of the shaft 260 is secured by a nut or cap 274 which rotates against thrust washer 276. Upon rotation of the knob 266, the friction can be varied to vary the resistance to movement of the structure 20 relative to the frame 12.

Other resistance structure including springs positioned comparable to cylinder 38 or along shaft 22 may be used as desired.

It should be understood that as the hydraulic cylinder 38 or other resistance structure resists movement of the user support structure 20 between the first position and the second position 24 of FIG. 3, it simultaneously resists movement of the lever structure from its first position as shown in FIG. 1 to its second position shown in FIG. 3. As noted hereinbefore, alternate resistance may include a spring positioned in a cylinder or on the shaft 22. A gas spring may also be an acceptable alternate for the hydraulic cylinder 38.

Returning to FIGS. 1–3 in the first position, the user handle structure or handle bar 62 is positioned away from the frame with the foot support structure 32 positioned inwardly or toward the frame 12. Upon movement of the lever structure 30 to the second position shown in phantom 66, and also in FIG. 3, the handle bar structure 62 is positioned inwardly or toward the frame 12 and toward the saddle 26 positioned in its second position 24. Concurrently, the foot structure 32 associated with the limb structure 30 is rotated outwardly away from the frame 12.

As here shown, the foot support structure 32 is a pair of pedals 86 and 88 each rotatably positioned proximate the distal ends 89 and 91 respectively of the left lever member 56 and the right lever member 58. Although the pedals 86 and 88 are here shown positioned proximate the distal ends 89 and 91, the pedals 86 and 88 may be positioned at any convenient location along the left lever member 56 and the right lever member 58 as desired.

As shown in FIG. 1, separate foot supports 90 and 92 are secured to the left lever member 56 and the right lever member 58 respectively to receive the feet of a user in the performance of exercises in a separate or different configuration.

In FIG. 1, the handle bar 62 is here shown to have an outwardly extending portion 94 an upwardly extending or handle portion 96 and an inwardly extending portion 98. Similarly on the left side, the handle bar 62 also includes an outwardly extending portion 100 and upwardly extending portion 102 and an inwardly extending portion 104. The handle bar structure is unitarily formed as illustrated and is v-shaped with an apex 106 centrally positioned.

In use, the user may grasp the handle bar 62 any where along its various portions including the outwardly extending portions 94 and 100 as well as the upwardly extending portions 96 and 102 or the inwardly extending portions 98 and 104. Further, the user may grasp the handle bar 62 with the fingers oriented inwardly or toward the apex as well as outwardly or away from the handle bar 62. In so doing, the user may exercise different muscles or exercise the muscles in different ways.

An optional feature of the illustrated embodiment includes an adjustable handle bar member 62. More specifically, collars 108 and 110 may be friction nuts which simply are rotated by the user to secure the handle bar in a desired position either higher or upward or lower or downward 112 in order to accommodate users of different height.

It may also be noted that the support 28 of the limb means has an electronic control console 114. As here illustrated and as contemplated, the electronic control console 114 includes means for timing the length or duration of the exercise and means to count repetition or movements of the lever structure 30 between its first position and its second position 66. Alternate electronic features may be included such as heart rate, pulse rate and the like if desired.

As better seen in FIG. 4, it may be noted that the hydraulic cylinder 38 is positioned to extend downward or below the frame 12 and more particularly the central portion 14 of the frame 12. A left strap 116 and a right strap 118 are each made of an appropriate metal or comparable material and are secured by conventional means such as bolts, nuts or welding to the left element 42 and the right element 44 of the frame 12 to extend downwardly. The first leg structure 16 and the second leg structure 18 are formed to have sufficient length to position the central portion 14 of the frame 12 above the support surface at a height 120 so that in the first position the saddle 26 may be easily mounted by a user standing on the support surface. In turn, the length of the strap 116 and 118 and the length of the cylinder 38 is selected to be less than the height 120.

In operation, the user is positioned proximate the unit near the saddle or user support 26. The user raises a leg and swings it over the saddle 26 to seat the user on the user support 26. Thereafter the user places the user's feet on the pedals 86 and 88 while reaching for and grasping the handle bar 62. Upon pulling the handle bar 62 toward the user, and in turn pushing with the feet on the pedals 86 and 88, the lever structure 30 rotates towards its second position (FIG. 3) and the saddle 26 and in turn the user supper structure 20 rotate up to the second position 24 thereby exercising the muscles in the legs and the arms. Repetitive movement on a regular basis provides for aerobic exercise as well as for some anaerobic conditioning of the muscles in the limbs of the user.

It is to be understood that the embodiments of the invention herein described are merely illustrative of the application of the principals of the invention. Reference herein to the details of the illustrated embodiment is not intended to limit the scope of the claims which themselves recite those features regarded as essential to the invention.

What is claimed is:

1. A riding exercise machine having a frame with movable structure for operation by a user, said riding exercise machine comprising:

a frame including means for supporting said frame upon a support surface;

movable structure for operation by a user, said movable structure including a user support structure having a proximal end and a distal end with a user support positioned proximate said distal end to support a user thereon, said user support structure being rotatably connected to said frame proximate said proximal end and said user support structure being movable between a first position and a second position displaced from said first position, and limb means for operation by the limbs of a user and rotatably connected to said frame, said limb means having foot structure for supporting the user's feet when the user is positioned upon said user support and hand structure for grasping by a user's hand when the user is positioned on said user support, said limb means being movable against the weight of a user positioned on said user support between a first position in which said foot structure is positioned toward said user support and said hand structure is positioned away from said user support so that a user positioned on said user support has flexed knees and extended arms, and a second position in which said foot structure is positioned outwardly away from said user support and said hand structure is positioned inwardly toward said user support so that a user positioned on said user support has extended legs and flexed arms;

connection means for interconnecting said limb means and said user support structure to urge said user support structure to its first position with said limb means in its first position and to urge said limb means to its second position upon movement of said user support structure to its second position; and resistance means interconnected between said frame and said movable structure to resist movement of said movable structure.

2. The exercise machine of claim 1, wherein said limb means includes a support secured to said frame formed to extend away therefrom and a lever member rotatably secured thereto, said lever member having said hand structure proximate an upper end of said lever member and having said foot structure proximate a lower end of said lever member.

3. The exercise machine of claim 2, wherein said connection means includes a bar member having one end rotatably connected to said lever member and the other end rotatably connected to said user support structure.

4. The exercise machine of claim 3, wherein said resistance means is connected proximate said other end of said bar structure and to said user support structure.

5. An exercise machine comprising:

a frame including means for supporting said frame upon a support surface;

a user support structure having a proximal end and a distal end with a user support positioned proximate said distal end to support a user thereon, said user support structure being rotatably connected to said frame proximate said proximal end and said user support structure being movable between a first position and a second position displaced from said first position;

limb means for operation by the limbs of a user and rotatably connected to said frame, said limb means having foot structure for supporting and for movement by the user's feet when the user is positioned upon said user support and hand structure for grasping and for movement by a user's hand when the user is positioned on said user support, said limb means being movable between a first position in which said foot structure is positioned toward said user support and said hand structure is positioned away from said user support, and a second position in which said foot structure is positioned outwardly away from said user support and said hand structure is positioned inwardly toward said user support;

connection means for interconnecting said limb means and said user support structure to urge said user support structure to its first position with said limb means in its first position and to urge said limb means to its second position upon movement of said user support structure to its second position; and resistance means interconnected between said frame and said user support structure to resist movement of said limb means and said user support structure.

6. The exercise machine of claim 5, wherein said resistance cylinder is a hydraulic cylinder.

7. The exercise machine of claim 6, wherein said hydraulic cylinder includes means to adjust the resistance to movement thereof.

8. The exercise machine of claim 5, wherein said means for supporting said frame upon a support surface includes a first leg structure extending outwardly from said frame, said first leg structure being formed for positioning on a support surface and a second leg structure extending outwardly from said frame and spaced from said first leg structure, said second leg structure being formed for positioning on a support surface.

9. The exercise machine of claim 8, wherein said frame includes a pair of spaced apart members and wherein said resistance cylinder is positioned between said pair of spaced apart members.

10. The exercise machine of claim 9, wherein said support of said limb means extends upwardly and outwardly from said first leg structure and wherein said lever is rotatably connected thereto proximate the distal end of said support.

11. The exercise machine of claim 10, wherein said lever member includes a left member and a right member spaced from said left member with a handle bar connected thereto at the upper end of said pair of spaced apart members, and wherein the bar member of said connection means has a left member connected to the left member of said lever and a right member connected to said right member of said lever.

12. An exercise machine comprising:

a frame including means for supporting said frame upon a support surface having a first leg structure extending outwardly from said frame, said first leg structure being formed for positioning on the support surface and a second leg structure extending outwardly from said frame and spaced from said first leg structure, said second leg structure being formed for positioning on the support surface, and said frame including a pair of spaced apart members;

a user support structure having a proximal end and a distal end with a user support positioned proximate said distal end to support a user thereon, said user support structure being rotatably connected to said frame proximate said proximal end and said user support structure being movable between a first position and a second position displaced from said first position;

limb means for operation by the limbs of a user and rotatably connected to said frame, said limb means having foot structure for supporting the user's feet when the user is positioned upon said user support and hand structure for grasping by a user's hand when the user is positioned on said user support, said limb means being movable between a first position in which said foot structure is positioned toward said user support and said hand structure is positioned away from said user support, and a second position in which said foot structure is positioned outwardly away from said user support and said hand structure is positioned inwardly toward said user support, said limb means including a support secured to said frame formed to extend upwardly and outwardly away therefrom and a lever member rotatably secured thereto at a distal end thereof, said lever member having said hand structure proximate an upper end of said lever member and having said foot structure proximate a lower end of said lever member, and said lever member including a left member and a right member spaced from said left member with a handle bar connected thereto at the upper end of said pair of spaced apart members;

connection means for interconnecting said limb means and said user support structure to urge said user support structure to its first position with said limb means in its first position and to urge said limb means to its second position upon movement of said user support structure to its second position, said connection means including a bar member having one end rotatably connected to said lever member and the other end rotatably connected to said user support structure, said bar member having a left member connected to the left member of said lever and a right member connected to said right member of said lever; and an hydraulic cylinder connected at one end of said bar member and said user support structure and at its other end to said frame between said spaced apart members to resist movement of said limb means and said user support structure, said hydraulic cylinder including means to adjust the resistance to movement thereof.

13. The exercise machine of claim 12, wherein said left member and said right member of said connection means are rotatably connected to said user support structure by a pin.

14. The exercise machine of claim 13, wherein said resistance cylinder has a bushing at one end connected to said user support structure by said pin.

15. The exercise machine of claim 14, further including monitoring means positioned proximate the distal end of said support of said limb means to monitor the exercise to be performed.

16. An exercise machine comprising:

a frame including means for supporting said frame upon a support surface;

a user support structure having a proximal end and a distal end with a user support positioned proximate said distal end to support a user thereon, said user support structure being rotatably connected to said frame proximate said proximal end and said user support structure being movable between a first position and a second position displaced from said first position;

limb means for operation by the limbs of a user and rotatably connected to said frame, said limb means having foot structure for supporting and for movement by the user's feet when the user is positioned upon said user support and hand structure for grasping and for movement by a user's hand when the user is positioned on said user support, said limb means being movable between a first position in which said foot structure is positioned toward said user support and said hand structure is positioned away from said user support, and a second position in which said foot structure is positioned outwardly away from said user support and said hand structure is positioned inwardly toward said user support, said limb means including a support secured to said frame and formed to extend away therefrom and said limb means including a lever member rotatably secured to said frame, said lever member having said hand structure proximate the upper end of said lever member and having said foot structure proximate the lower end of said lever member;

connection means for interconnecting said limb means and said user support structure to urge said user support structure to its first position with said limb means in its first position and to urge said limb means to its second position upon movement of said user support structure to its second position, said connection means including a bar member having one end rotatably connected to said lever member and the other end rotatably connected to said user support structure; and a resistance cylinder interconnected to and between said frame and said user support structure and proximate to said other end of said bar structure to resist movement of said limb means and said user support structure.

17. A riding exercise machine having a frame with movable structure for operation by a user, said riding exercise machine comprising:

a frame including means for supporting said frame upon a support surface;

movable structure for operation by a user, said movable structure including a user support structure having a proximal end and a distal end with a user support positioned proximate said distal end to support a user thereon, said user support structure being rotatably connected to said frame proximate said proximal end and said user support structure being movable between a first position and a second position displaced from said first position, and limb means for operation by the limbs of a user and rotatably connected to said frame, said limb means having foot structure for supporting and for movement by the user's feet when the user is positioned upon said user support and hand structure for grasping and for movement by a user's hand when the user is positioned on said user support, said limb means being movable against the weight of a user positioned on said user support between a first position in which said foot structure is positioned toward said user support and said hand structure is positioned away from said user support so that a user positioned on said user support has flexed knees and extended arms, and a second position in which said foot structure is positioned outwardly away from said user support and said hand structure is positioned inwardly toward said user support so that a user positioned on said user support has extended lens and flexed arms;

connection means for interconnecting said limb means and said user support structure to urge said user support structure to its first position with said limb means in its first position and to urge said limb means to its second position upon movement of said user support structure to its second position; and resistance means interconnected between said frame and one of said user support structure and said limb means to resist movement of said limb means and said user support structure.

18. A riding exercise machine having a frame with movable structure for operation by a user, said riding exercise machine comprising:

a frame including means for supporting said frame upon a support surface;

movable structure for operation by a user, said movable structure including a user support structure having a proximal end and a distal end with a user support positioned proximate said distal end to support a user thereon, said user support structure being rotatably connected to said frame proximate said proximal end and said user support structure being movable between a first position and a second position displaced from said first position, and limb means for operation by the limbs of a user and rotatably connected to said frame, said limb means having foot structure for supporting and for movement by the user's feet when the user is positioned upon said user support and hand structure for grasping and for movement by a user's hand when the user is positioned on said user support, said limb means being movable against the weight of a user positioned on said user support between a first position in which said foot structure is positioned toward said user support and said hand structure is positioned away from said user support so that a user positioned on said user support has flexed knees and extended arms, and a second position in which said foot structure is positioned outwardly away from said user support and said hand structure is positioned inwardly toward said user support so that a user positioned on said user support has extended lens and flexed arms;

connection means for interconnecting said limb means and said user support structure to urge said user support structure to its first position with said limb means in its first position and to urge said limb means to its second position upon movement of said user support structure to its second position; and resistance means interconnected between said frame and said movable structure to resist movement of said movable structure.

19. A riding exercise machine comprising:

a frame including means for supporting said frame upon a support surface;

a user support structure having a proximal end and a distal end with a user support positioned proximate said distal end to support a user thereon, said user support structure being rotatably connected to said frame proximate said proximal end and said user support structure being movable between a first position and a second position displaced from said first position;

limb means for operation by the limbs of a user and rotatably connected to said frame, said limb means having foot structure for supporting the user's feet when the user is positioned upon said user support and hand structure for grasping by a user's hand when the user is positioned on said user support, said limb means being movable against the weight of a user positioned on said user support between a first position in which said foot structure is positioned toward said user support and said hand structure is positioned away from said user support so that a user positioned on said user support has flexed knees and extended arms, and a second position in which said foot structure is positioned outwardly away from said user support and said hand structure is positioned inwardly toward said user support so that a user positioned on said user support has extended legs and flexed arms;

connection means for interconnecting said limb means and said user support structure to urge said user support structure to its first position with said limb means in its first position and to urge said limb means to its second position upon movement of said user support structure to its second position; and resistance means interconnected between said frame and one of said user support structure and said limb means to resist movement of said limb means and said user support structure.

20. An exercise machine comprising:

a frame including means for supporting said frame upon a support surface;

a user support structure having a proximal end and a distal end with a user support positioned proximate said distal end to support a user thereon, said user support structure being rotatably connected to said frame proximate said proximal end and said user support structure being movable between a first position and a second position displaced from said first position;

limb means for operation by the limbs of a user and rotatably connected to said frame, said limb means having foot structure for supporting the user's feet when the user is positioned upon said user support and hand structure for grasping by a user's hand when the user is positioned on said user support, said limb means being movable between a first position in which said foot structure is positioned toward said user support and said hand structure is positioned away from said user support, and a second position in which said foot structure is positioned outwardly away from said user support and said hand structure is positioned inwardly toward said user support, said limb means including a support secured to said frame formed to extend away therefrom and a lever member rotatably secured thereto, said lever member having said hand structure proximate an upper end of said lever member and having said foot structure proximate a lower end of said lever member, and said lever member including a left member and a right member spaced from said left member with a handle bar connected thereto at the upper end of said pair of spaced apart members;

connection means for interconnecting said limb means and said user support structure to urge said user support structure to its first position with said limb means in its first position and to urge said limb means to its second position upon movement of said user support structure to its second position, said connection means including a bar member having one end rotatably connected to said lever member and the other end rotatably connected to said user support structure, said bar member moving a left member connected to the left member of said lever and a right member connected to said right member of said lever; and resistance means interconnected between said frame and selectively either said user support structure or said limb means to resist movement of said limb means and said user support structure.

21. The exercise machine of claim 20, wherein said resistance means is a hydraulic cylinder connected at one end to said bar structure and at the other end to said frame, said hydraulic cylinder including means to adjust the resistance to movement thereof.

22. The exercise machine of claim 20, wherein said means for supporting said frame upon a support surface includes a first leg structure extending outwardly from said frame, said first leg structure being formed for positioning on a support surface and a second leg structure extending outwardly from said frame and spaced from said first leg structure, said second leg structure being formed for positioning on a support surface.

23. The exercise machine of claim 21, wherein said frame includes a pair of spaced apart members and wherein said resistance cylinder is positioned between said pair of spaced apart members.

24. The exercise machine of claim 20, further including monitoring means positioned proximate the distal end of said support of said limb means to monitor the exercise to be performed.

* * * * *